US009085453B2

(12) United States Patent
McMahan et al.

(10) Patent No.: US 9,085,453 B2
(45) Date of Patent: Jul. 21, 2015

(54) REFRIGERATOR WITH AUTOMATIC LIQUID DISPENSER

(71) Applicant: Electrolux Home Products, Inc., Charlotte, NC (US)

(72) Inventors: Travis McMahan, Honea Path, SC (US); Nilton Bertolini, Anderson, SC (US); Thomas R. Thompson, Anderson, SC (US); Jorge Carlos Montalvo Sanchez, Anderson, SC (US); Cornel Comsa, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 410 days.

(21) Appl. No.: 13/709,525

(22) Filed: Dec. 10, 2012

(65) Prior Publication Data

US 2013/0146179 A1 Jun. 13, 2013

Related U.S. Application Data

(60) Provisional application No. 61/568,939, filed on Dec. 9, 2011.

(51) Int. Cl.
*B67D 1/00* (2006.01)
*B67D 7/22* (2010.01)
(Continued)

(52) U.S. Cl.
CPC ..... *B67D 7/221* (2013.01); *B67D 1/124* (2013.01); *B67D 1/1238* (2013.01);
(Continued)

(58) Field of Classification Search
CPC ..... F25D 2331/81; F25D 2331/806; F25D 2323/122; F25D 23/126; B67D 2210/00036; B67D 1/1238; B67D 1/124; B67D 2001/1268; B67D 2600/02
USPC ..... 141/94–95, 198, 351, 360, 375; 62/389, 62/338, 339, 377; 222/146.6, 64, 129.1; 73/290 R, 304 C; 340/620; 361/284
See application file for complete search history.

(56) References Cited

U.S. PATENT DOCUMENTS 2,031,283 A 2/1936 Scofield
3,094,154 A 6/1963 Daniels
(Continued)

FOREIGN PATENT DOCUMENTS

DE 102010026866 A1 1/2011
GB 2 449 630 A 3/2008
(Continued)

OTHER PUBLICATIONS

International Search Report for PCT/US2012/070770, dated Feb. 4, 2014, 2 pages.
(Continued)

*Primary Examiner* — Timothy L Maust
*Assistant Examiner* — Timothy P Kelly
(74) *Attorney, Agent, or Firm* — Pearne & Gordon LLP

(57) ABSTRACT

A refrigerator includes a cabinet defining a fresh food compartment and a door pivotally mounted to the cabinet and including an interior surface in communication with the fresh food compartment when the door is closed. A liquid dispenser is arranged on the interior surface of the door, and a container is supported on the door and configured to receive liquid from the liquid dispenser. A sensor is configured to sense a property of the container, and a control is in communication with the sensor. The control is configured to regulate dispensing of liquid into the container based upon the sensed property of the container. In one example, the sensor is resiliently biased into contact with the container to sense a property of the container. In another example, the control indicates a stale liquid condition if a timer expires before the container has been removed from the door.

15 Claims, 8 Drawing Sheets

(51) Int. Cl.
*B67D 1/12* (2006.01)
*F25D 23/12* (2006.01)

(52) U.S. Cl.
CPC ..... *F25D 23/126* (2013.01); *B67D 2001/1268* (2013.01); *F25D 2323/122* (2013.01); *F25D 2331/81* (2013.01); *F25D 2600/02* (2013.01)

(56) References Cited

U.S. PATENT DOCUMENTS

| | | | | |
|---|---|---|---|---|
| 3,178,061 | A | 4/1965 | Giacalone et al. | |
| 3,678,753 | A | 7/1972 | Eggleston et al. | |
| 3,913,401 | A | 10/1975 | Sweeney | |
| 4,451,894 | A | 5/1984 | Dougherty et al. | |
| 4,712,591 | A | 12/1987 | McCann et al. | |
| 4,895,194 | A | 1/1990 | McCann et al. | |
| 5,156,021 | A | 10/1992 | St-Gelais et al. | |
| 5,490,547 | A | 2/1996 | Abadi et al. | |
| 5,542,572 | A | 8/1996 | Davis | |
| 5,802,910 | A | 9/1998 | Krahn et al. | |
| 5,827,428 | A | 10/1998 | Chang | |
| 6,148,624 | A | 11/2000 | Bishop et al. | |
| 6,574,984 | B1 | 6/2003 | McCrea et al. | |
| 6,679,400 | B1 | 1/2004 | Goodman | |
| 6,681,585 | B1 | 1/2004 | Stagg et al. | |
| 6,708,518 | B1 | 3/2004 | Jones et al. | |
| 6,761,067 | B1 * | 7/2004 | Capano | 73/304 C |
| 6,810,682 | B1 | 11/2004 | Schuchart et al. | |
| 6,827,097 | B2 | 12/2004 | Goodman | |
| 7,000,468 | B2 | 2/2006 | Doorhy et al. | |
| 7,171,993 | B2 | 2/2007 | Bethuy et al. | |
| 7,549,299 | B2 | 6/2009 | Kolb Filho et al. | |
| 7,658,212 | B2 | 2/2010 | Meuleners et al. | |
| 8,011,203 | B1 | 9/2011 | Schenk et al. | |
| 8,109,301 | B1 * | 2/2012 | Denise | 141/360 |
| 8,245,735 | B2 | 8/2012 | Chase et al. | |
| 8,377,292 | B2 | 2/2013 | Patera et al. | |
| 2003/0097314 | A1 * | 5/2003 | Crisp et al. | 705/28 |
| 2005/0039420 | A1 | 2/2005 | Albritton et al. | |
| 2005/0178273 | A1 | 8/2005 | Meuleners et al. | |
| 2007/0278141 | A1 | 12/2007 | Patera et al. | |
| 2009/0183796 | A1 | 7/2009 | Chase et al. | |
| 2009/0258120 | A1 * | 10/2009 | Zeitler et al. | 426/232 |
| 2010/0159077 | A1 | 6/2010 | Skalski et al. | |
| 2011/0067433 | A1 | 3/2011 | An et al. | |
| 2011/0265562 | A1 | 11/2011 | Li | |
| 2012/0111049 | A1 | 5/2012 | Kim et al. | |
| 2013/0133352 | A1 | 5/2013 | Park et al. | |
| 2013/0133354 | A1 | 5/2013 | Park | |
| 2013/0133355 | A1 | 5/2013 | Park et al. | |

FOREIGN PATENT DOCUMENTS

| | | |
|---|---|---|
| JP | 0678733 | 3/1994 |
| JP | 06323721 | 11/1994 |
| JP | 07155154 | 6/1995 |
| JP | 2008215716 | 9/2008 |
| TW | M424905 U1 | 3/2012 |

OTHER PUBLICATIONS

International Search Report issued in Application No. PCT/US2012/070770 dated Feb. 4, 2014.

Written Opinion issued in Application No. PCT/US2012/070770 dated Feb. 4, 2014.

* cited by examiner

REFRIGERATOR WITH AUTOMATIC LIQUID DISPENSER

CROSS-REFERENCE TO RELATED APPLICATIONS

This application claims the benefit of U.S. Provisional Application No. 61/568,939, filed Dec. 9, 2011, the entire disclosure of which is hereby incorporated herein by reference.

FIELD OF THE INVENTION

The present application relates generally to a liquid dispenser for an appliance, and more particularly, to an automatic liquid dispenser for an appliance.

BACKGROUND OF THE INVENTION

Appliances, such as refrigerators, are known to include internal and/or external water dispensers. Additionally, appliances are known to include containers for holding water within the appliance.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, a refrigerator comprises a cabinet defining a fresh food compartment and a door pivotally mounted to the cabinet and comprising an interior surface in communication with the fresh food compartment when the door is closed. A liquid dispenser is arranged on the interior surface of the door, and a container is supported on the door and configured to receive liquid from the liquid dispenser. A sensor is configured to sense a property of the container, and a control is in communication with the sensor. The control is configured to regulate dispensing of liquid into the container based upon the sensed property of the container.

In accordance with another aspect, a refrigerator comprises a cabinet defining a fresh food compartment and a door pivotally mounted to the cabinet and comprising an interior surface in communication with the fresh food compartment when the door is closed. A liquid dispenser is arranged on the interior surface of the door comprising a spout and a support shelf arranged below the spout, and a container is supported on the support shelf of the door and configured to receive liquid from the spout. A sensor is resiliently biased into contact with the container and configured to sense a property of the container. A control is in communication with the sensor and configured to regulate dispensing of liquid into the container via the spout based upon the sensed property of the container.

In accordance with another aspect, a method of dispensing a liquid from a refrigerator comprises the step of sensing a presence of a container on an interior surface of a door in communication with a fresh food compartment of the refrigerator. The method further comprises the steps of sensing a presence of liquid within the container, initiating a timer, and indicating a stale liquid condition if the timer expires before the container has been removed from the door.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
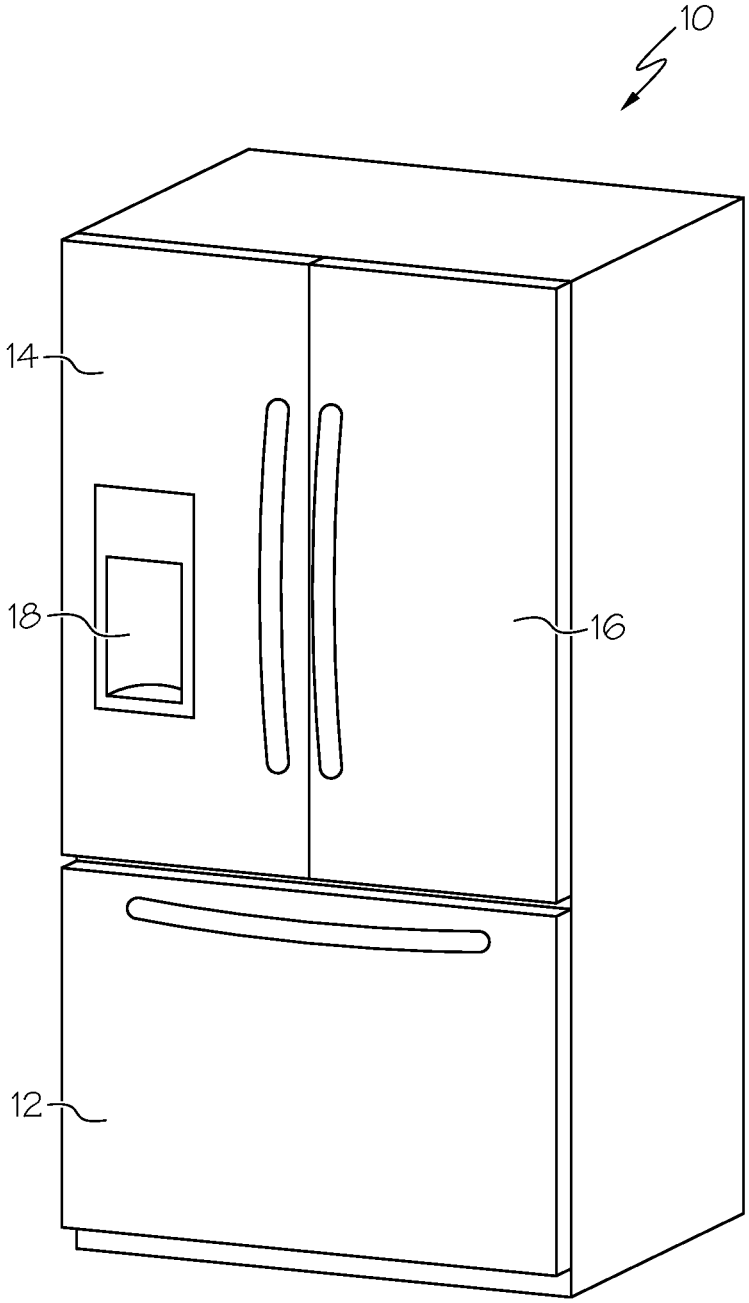
FIG. 1 is a schematic view of an example refrigerator.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Described herein is an apparatus and method for dispensing liquid for filling a water pitcher or carafe automatically within an appliance, such as within a refrigerator compartment. The apparatus is used to supply a user with a full pitcher of liquid when the user opens the refrigerator door. For example, the pitcher can fill automatically when the door shuts. As will be described herein, it is contemplated that the term "full" is intended to mean filled to a predetermined level that may be fixed or alterable. Additionally, although the term "water" is used herein as an example, it is contemplated that apparatus could be used with various other liquids.

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C. and the freezer compartments at temperatures below 0° C.

Turning to the shown example of FIG. 1, a refrigeration appliance is illustrated in the form of a domestic refrigerator, indicated generally at 10. Although the detailed description of an embodiment of the present invention that follows concerns a domestic refrigerator 10, the invention can be embodied by refrigeration appliances other than with a domestic refrigerator 10. Further, an embodiment is described in detail below, and shown in the figures as a "bottom-mount" configuration of a refrigerator 10, including a cabinet defining a fresh-food compartment 14 disposed vertically above a freezer compartment 12. Still, the cabinet can define the fresh-food compartment 14 laterally beside the freezer compartment 12 (i.e., a "side-by-side" refrigerator) or freezer compartment 12 above the fresh-food compartment 14 (i.e., a "top-mount" refrigerator).

One or more doors 16 shown in FIG. 1 are pivotally coupled to a cabinet of the refrigerator 10 to restrict and grant access to the fresh food compartment 14. The door 16 can include a single door that spans the entire lateral distance across the entrance to the fresh food compartment 14 (see FIG. 3), or can include a pair of French-type doors 16 as shown in FIG. 1 that collectively span the entire lateral distance of the entrance to the fresh food compartment 14 to enclose the fresh food compartment 14. For the latter configuration, a center mullion coupled to at least one of the doors 16 to establish a surface against which the doors 16 can seal the entrance to the fresh food compartment 14 at a location between opposing side surfaces of the doors 16.

Conventionally, a dispenser 18 for dispensing at least ice pieces, and optionally water can be provided to one of the doors 16 that restricts access to the fresh food compartment 14 shown in FIG. 1. Generally, the dispenser 18 can include a lever, switch, proximity sensor or other device that a user can interact with to cause frozen ice pieces to be dispensed from an ice bin (not shown) provided to an ice maker (not shown) disposed within the fresh food compartment 14 through the door 16. Ice pieces from the ice bin can be delivered to the dispenser via an ice chute or the like that extends at least partially through the door 16 between the dispenser 18 and the ice bin.

Figure 2:
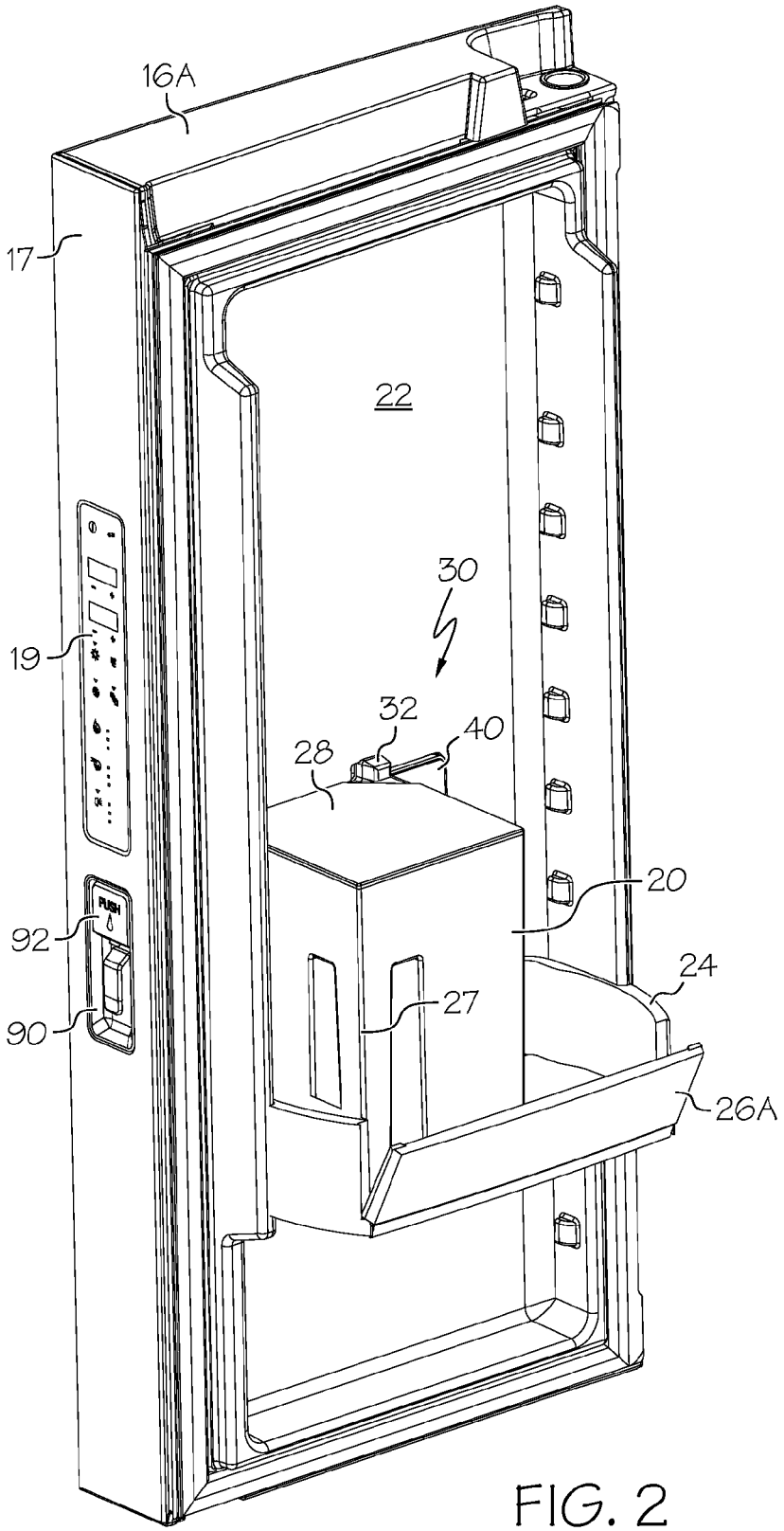
FIG. 2 is a perspective view of one example refrigerator door with an example water pitcher.
Figure 3:
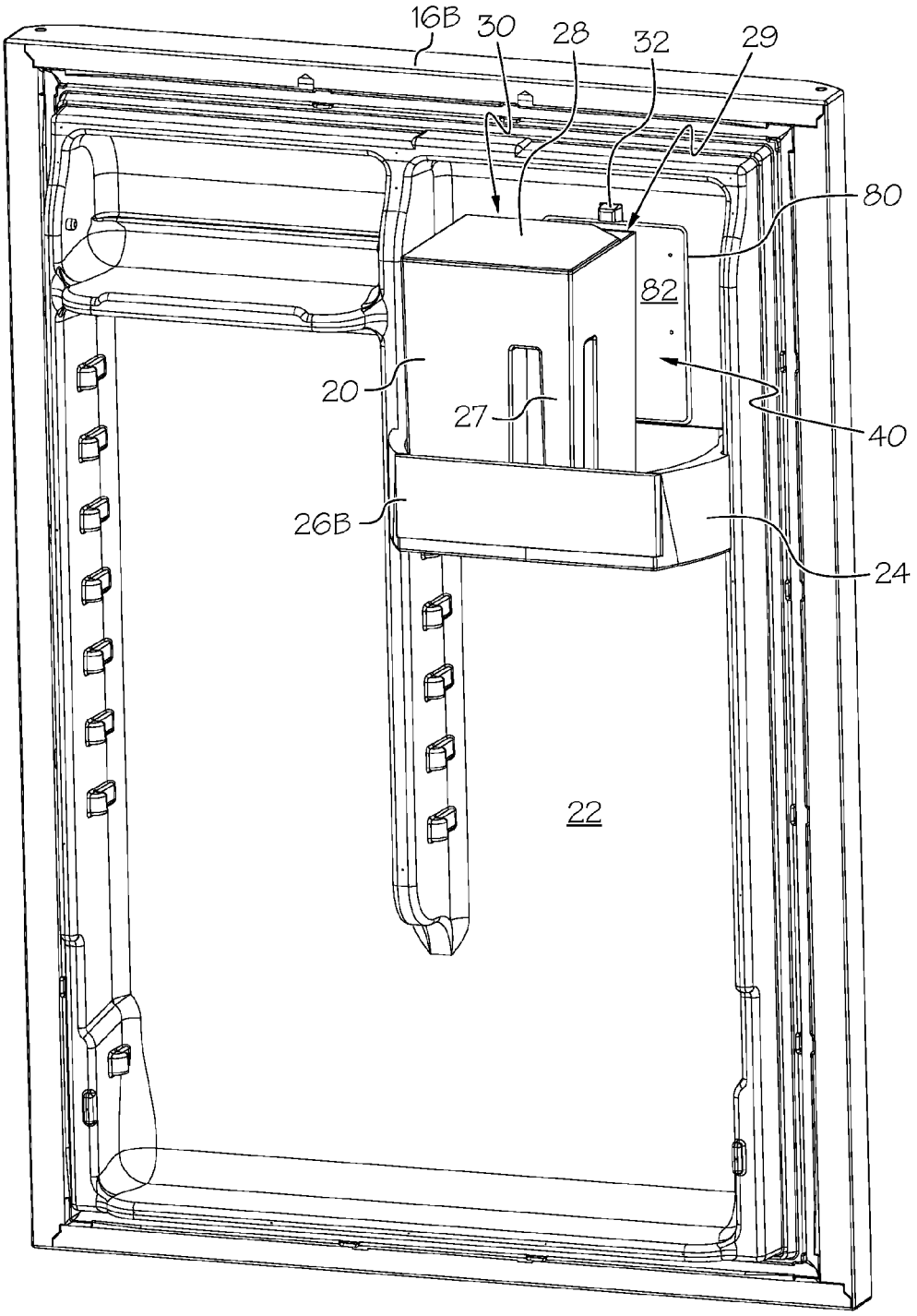
FIG. 3 is a perspective view of another example refrigerator door with an example water pitcher.

However, it is contemplated that the subject application can be used with a refrigerator that does not include a dispenser on a front exterior surface of the door 16 to provide a particular aesthetic look to the refrigerator. Instead, as shown in FIGS. 2-3, the refrigerator 10 can include a container for storing liquid, such as a water pitcher 20 or carafe, located within an interior compartment. Although the term "water pitcher" is used herein as an example, it is contemplated that apparatus could be used with various other containers and liquids. Preferably, the water pitcher 20 is located within the fresh food compartment. The water pitcher 20 can be supported on an interior surface 22 of the refrigerator door 16A, 16B that is in communication with the fresh food compartment 14 when the door 16A, 16B is closed.

As shown in FIG. 2, the refrigerator door 16A can be configured for use as one of a pair of French-type doors, such as for use in a "bottom mount"-style refrigerator. Alternatively, as shown in FIG. 3, the refrigerator door 16B can be configured for use as a single door that spans the entire lateral distance of the entrance to the fresh food compartment, such as for use in a "top mount"-style refrigerator. It is understood that the water pitcher 20 and associated filling structure and methodology discussed herein can be similar, or even different, on the various types of refrigerator doors 16A, 16B.

Each refrigerator door is insulated to minimize the escape of heat from the fresh food compartment 14, and thus have a depth dimension that includes substantially-planar side portions 17 extending at least a part of the way between an exterior face exposed to an ambient environment of the refrigerator 10 and the interior surface 22 that is exposed to an interior of the fresh food compartment 14 while the doors are closed. With reference to the French door configuration 16A of FIGS. 1-2, substantially-planar side portions 17 generally oppose each other when the doors 16A are in their closed positions. A user interface 19 can be at least partially recessed within the side portion 17 of at least one of the doors 16A such that an exterior surface of the user interface 19 is substantially flush with the side portion 17 of the door 16A. When the doors 16A are in their closed positions, the user interface 19 can be substantially hidden from view when the refrigerator 10 is viewed from the front. By substantially hidden from view it is meant that the user interface 19 faces the side portion 17 of the other door, and does not have a noticeable outward appearance, thereby giving the refrigerator 10 a clean look without requiring the user interface 19 to be disposed within the fresh food compartment 14 or freezer compartment 12. Other embodiments include a user interface 19 that is not necessarily flush with the side portion 17, but is recessed into the side portion 17 and set back from the side portion 17. According to other embodiments, the user interface 19 can project outwardly from the side portion 17, but to a lesser extent than the distance separating the side portions of the doors 16A, providing enough clearance to allow the doors 16A to swing closed without contacting each other. In still other embodiments, the user interface 19 can be located within the fresh food compartment 14 and/or freezer compartment 12.

A door bin system can be provided for retaining the water pitcher 20 or carafe within the interior of the refrigerator. For example, the water pitcher 20 can be supported on a movable or non-movable shelf 24. The shelf 24 can have a recessed configuration providing a recess 25 or well to receive and retain the water pitcher 20. In addition or alternatively, the door bin system can include mating structure to assist in properly locating the water pitcher 20 within the door bin system, and/or various retaining or even locking structure to inhibit inadvertent removal of the water pitcher 20, while permitting purposeful removal. The water pitcher 20 can include various geometries, such as square, rectangular, curved, oval, triangular, polygonal, etc. In one example, the water pitcher 20 can have a generally square or rectangular geometry that corresponds generally with the bounded geometry of the shelf 24 and recess 25 so that the water pitcher 20 nests and fits snugly therein.

The support shelf could provide for various methods of removing the water pitcher 20 therefrom, such as vertical removal, front or side lateral removal. The shelf 24 can include a movable (or even removable) front surface 26A (see FIG. 2), such as a pivotable door (or removable panel), to facilitate front or side lateral removal of the water pitcher 20. Front or side removal of the water pitcher 20 may permit an additional refrigerator shelf to be positioned above the water pitcher 20. In addition or alternatively, removal of the water pitcher 20 may deactivate the filling mechanism until the water pitcher 20 is replaced. Alternatively, the shelf 24 can include a non-movable front surface 26B (see FIG. 3), such that the water pitcher 20 is lifted vertically for removal from the shelf 24. The water pitcher 20 can include various other features, such as one or more handles 27 configured to be grasped by a user. The water pitcher 20 can further include a removable or non-removable top cover 28 or lid that can include an opening or pour spout 29 to permit a user to pour water into a glass or other vessel, and/or the pour spout may further provide an opening allow water ingress during filling.

The automatic liquid fill mechanism can be located variously within the refrigerator. In addition or alternatively, the fill mechanism can be located as part of a shelf unit, drawer unit, and/or icemaker. In addition or alternatively, the fill mechanism can be located on the inside of the refrigerator door. For example, the refrigerator 10 can further include a liquid dispenser 30 arranged on the interior surface 22 of the door 16A, 16B. The liquid dispenser 30 receives liquid, such as water, from an inlet water supply, and dispenses the liquid via a spout 32 into the water pitcher 20. At least one actuator 34 (illustrated schematically, see FIG. 6A), such as an electromechanical valve, is disposed in fluid communication between the inlet water supply and the liquid dispenser 30 and is configured to selectively permit dispensing of the liquid via the spout 32. Optionally, a water filter (not shown) can be provided to the refrigeration appliance 10 to minimize impurities in fresh water to be dispensed.

The refrigerator 10 further includes a sensor 40 configured to sense a property of the water pitcher 20, and a control 50 in communication with the sensor 40 configured to regulate the dispensing of liquid into the water pitcher 20 based upon the sensed property of the water pitcher 20. For example, the actuator 34 can be operated (e.g., opened and closed) by the control 50 to selectively permit dispensing of the liquid via the spout 32. Additionally, the actuator 34 can be opened or closed to a varying degree to control the water flow rate therethrough for relatively faster or slower filling of the water pitcher 20, which could be controlled by the control 50 based upon sensor feedback during the filling process. Although the control 50 is illustrated adjacent to the water pitcher 20, it is contemplated that the control 50 could also be part of the main control circuitry of the refrigerator 10 and/or operated via the user interface 19. The control 50 may inhibit or permit operation of the actuator 34 and filling the water pitcher 20 while the refrigerator door 16A, 16B is in an open condition.

In one example, the property sensed by the sensor 40 is a presence of the water pitcher 20 adjacent to the liquid dispenser. Thus, the sensor 40 can detect whether the water pitcher 20 is retained on the shelf 24, or conversely the absence of the water pitcher 20. The sensor 40 could also be configured to sense the type or size of the water pitcher, and could adjust the filling and/or sensing parameters based upon the sensed type or size. In addition or alternatively, the property sensed by the sensor 40 is an amount of liquid within the water pitcher 20. Thus, the sensor 40 can detect the amount of liquid contained (e.g., fill level), such as a plurality of different amounts of liquid within the water pitcher 20. As will be described herein, the sensing structure and methods can directly or indirectly be used to control the automatic filling process.

The sensor 40 can utilize various sensing methods and structures for automatically sensing the presence and/or the amount of liquid within the water pitcher 20. In various examples, the sensing structure could utilize an infrared-sensing control system, an optical-sensing control system, a pressure and/or weight-sensing control system, a magnetic and/or electrical proximity sensing control system, electric field (E-field) sensing, inductive sensing, resistive sensing, temperature sensing control system, water flow sensing control system, electrical conductivity sensing control system, mechanical and/or electromechanical float switch sensing control system, and/or various other sensing systems capable of determining the presence and/or the amount of liquid within the water pitcher 20. In addition or alternatively, the sensor 40 can utilizes sound waves, such as via sonar or ultrasonic sound waves. In addition or alternatively, the sensor 40 can utilize an electrically conductive-path within the liquid in the water pitcher 20. For example, the sensor 40 can utilize the liquid contained within the water pitcher 20 to establish an electrically conductive path or circuit among two or more electrodes, such as a plurality in an array or the like.

Figure 5:
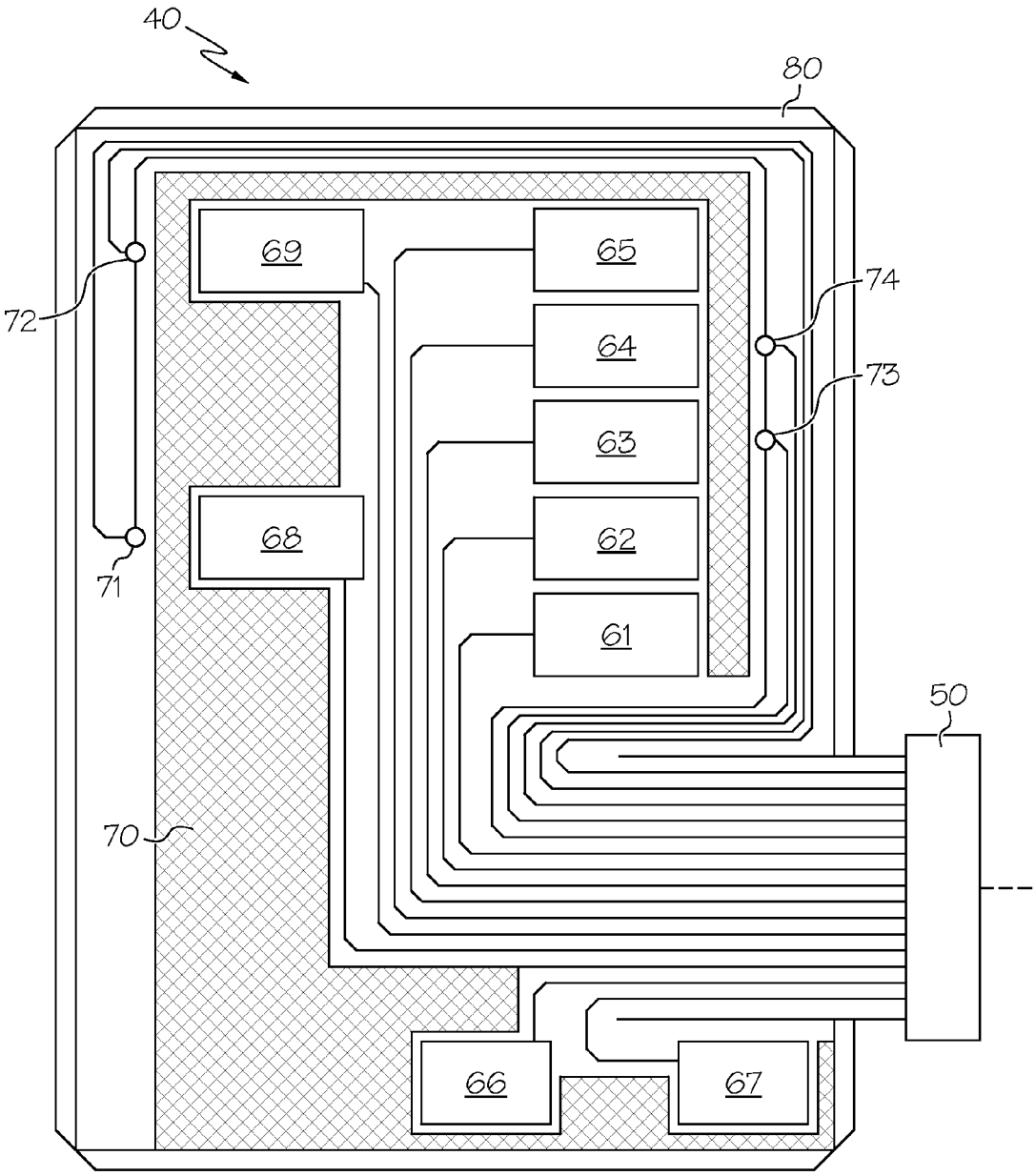
FIG. 5 is a schematic view of an example sensing circuit.

In addition or alternatively, the sensor 40 can utilize a capacitive sensor. Turning to FIG. 5, the sensor 40 is illustrated as a capacitive sensor. For example, the sensor 40 can include a plurality of capacitive sensors 61-69 configured to sense the presence and/or the amount of liquid within the water pitcher 20. Any or all of the capacitive sensors 61-69 may utilize a ground plane, such as a common ground plane 70 to determine an amount or change in capacitance. Additionally, any or all of the capacitive sensors 61-69 may be electrically coupled to the control 50 via wires, printed circuits, flex cables, or the like. While the sensor 40 will be described with reference to a capacitive sensor design, it is understood that the description can apply to any of the other types of sensors discussed herein.

A plurality of capacitive sensors 61-65 can be configured to sense a plurality of different amounts of liquid within the water pitcher 20. In one example, the plurality of capacitive sensors 61-65 are arranged in an array positioned to extend along a length of the water pitcher 20. As shown, the plurality of capacitive sensors 61-65 can be arranged in a vertical array positioned to extend along at least a portion of the vertical length of the water pitcher 20 when the water pitcher 20 is located adjacent to the sensor 40. It is contemplated that the outermost capacitive sensors 61 and 65 may correspond to the minimum and maximum amount of liquid capable of being contained within the water pitcher 20, respectively, so that the control 50 can determine the actual amount of liquid contained within the water pitcher 20 based upon input from the capacitive sensors 61-65. Alternatively, at least one of the outermost capacitive sensors 61-65 may correspond to an amount of liquid or may correspond to amounts more or less than the minimum and maximum, so that the control 50 can determine the estimated amount of liquid contained within the water pitcher 20 based upon input from the capacitive sensors 61-65 as well as additional information, such as predetermined information about the water pitcher 20. For example, FIG. 6B illustrates that the water pitcher 20 extends into the recess 25 below the example location of the first capacitive sensor 61. In the shown example, the control 50 can determine at least five amounts of liquid contained within the water pitcher 20 via the sensed values of the five capacitive sensors 61-65. The control 50 may also be configured to determine more than five amounts of liquid based utilizing multiple sensed values from two or more of the capacitive sensors 61-65 to achieve a greater resolution. In addition or alternatively, the control 50 may also be configured to determine the fill rate of the water pitcher 20, such as during a filling operation, based upon a rate of change of sensed values from the capacitive sensors 61-65.

In addition or alternatively, one or more capacitive sensors 66-67 can be configured to sense presence of the water pitcher 20 adjacent to the liquid dispenser. For example, a pair of capacitive sensors 66-67 can be located variously on the sensor 40, such as towards the bottom, to sense whether the water pitcher 20 is located adjacent to the sensor 40. Although it is possible to use only a single capacitive sensor, the use of a plurality of capacitive sensors can inhibit a false-positive reading, especially if a container other than the water pitcher 20 is placed on the shelf 24. For example, the plurality of capacitive sensors 66-67 can be located on the sensor 40 in a spaced-apart relationship so as to correspond generally to the geometry of the water pitcher 20. It is contemplated, however, that one or more of the level-sensors 61-65 could also be used to sense presence of the water pitcher 20 adjacent to the liquid dispenser. Additionally, the plurality of capacitive sensors 66-67 (and/or others of the sensors 61-65 or 68-69) could be used to determine a type or size of the water pitcher 20 to be filled.

In addition or alternatively, the refrigerator 10 can further include a user input configured to select one of a plurality of different fill amounts of liquid within the water pitcher 20. Thus, a user can have a "full" water pitcher that is filled to a predetermined level that may be fixed or alterable A user can have the water pitcher 20 automatically filled to a predetermined level, such as 50%, 75%, 100%, or other amount of the total available volume of the water pitcher 20. For example, one user may wish to have the water pitcher 20 automatically filled to about 100% to have the maximum amount of chilled water available. However, another user, such as a young or elderly user, may wish to only have the water pitcher 20 automatically filled to about 50% of the total available volume to thereby reduce the weight of the water pitcher 20 so that it is easier to remove from the shelf 24. One or more capacitive sensors 68-69 can be configured as the user input to enable the user to select one of the desired fill amounts of liquid within the water pitcher 20. The location of the capacitive sensors 68-69 can be adjacent to the actual liquid level contained within the water pitcher 20 when it is located on the shelf 24. Thus, a user can intuitively touch an area on the sensor 40 adjacent to the water pitcher 20 that corresponds to the amount of liquid fill level desired. Alternatively, the user input can include other types of switches, such as a membrane switch, push-button switch, computer-generated capacitive soft keys displayed by a LCD, OLED or other type of display, tactile buttons, multi-position switches, knobs, or any other input device that is operable to input a user selection, and/or can even be selected as part of the user interface 19 of the refrigerator 10. Upon selecting a desired fill level, the control 50 can operate the actuator 34 to permit the water pitcher 20 to be filled via the spout 32 until the desired amount of water (i.e., a predetermined "full" water pitcher amount) is sensed within the water pitcher 20.

Further, a feedback system can be configured to indicate at least one of a current amount of liquid in the water pitcher 20 and a selected amount of liquid in the water pitcher 20. For example, the feedback system can include at least one visual indicator, and preferably a plurality of visual indicators 71-72. The visual indicators 71-72 can be lights, such as LED lights or the like, that can be positioned adjacent to or part of the user input capacitive sensors 68-69 or switches used to select the desired fill level. For example, the indicators 71-72 can illuminate in response to the user actuating the capacitive sensors 68-69. In addition or alternatively, other visual indicators (not shown) can be located adjacent the indicators 71-72 or even the level-sensing capacitive sensors 61-65 to visually indicate the current amount of liquid in the water pitcher 20. Other types of feedback systems can be used, such as sound feedback and/or tactile feedback (e.g., vibration, etc.). In addition or alternatively, the indicators 71-72 can blink when the water pitcher 20 is sensed to be absent from the shelf 24, and can stay illuminated based once the water pitcher 20 is sensed as being docked onto the shelf 24 adjacent the sensor 40.

In addition or alternatively, another feedback system can be configured to indicate a stale liquid condition when the water pitcher 20 has not been removed from the door after a predetermined amount of time has elapsed. Liquid contained in the water pitcher 20, such as water, can become stale, undesirable, and/or unsanitary if the water pitcher 20 is not removed from the shelf 24 and used for a long period of time. Thus, the feedback system can monitor the amount of time the water pitcher 20 is on the shelf 24 without being removed, and alert the user after a predetermined amount of time has elapsed. The predetermined amount of time could be preset, or could even be adjustable by the user via the user interface 19 or other user input. The predetermined amount of time could be a few days, a week, two weeks, or other value generally related to an amount of time for the water to become stale, undesirable, and/or unsanitary. The feedback system can include at least one visual indicator, and preferably a plurality of visual indicators 73-74. The visual indicators 73-74 can be lights, such as LED lights or the like, positioned to be easily observable by a user when the water pitcher 20 is retained on the shelf 24. One light 73 can be used to indicate a stale water condition, and can be illuminated in an appropriate red or orange color. The other light 74 can be used to indicate an acceptable water condition, and can be illuminated in an appropriate green or blue color. Of course, various other colors can be used, and/or a single light or LED capable of emitting multiple colors could also be used. Other types of feedback systems can be used, such as sound feedback and/or tactile feedback (e.g., vibration, etc.). It is further contemplated that the indicator could be part of the user interface 19. In addition or alternatively, the indicators 73-74 can blink when the water pitcher 20 is sensed to be absent from the shelf 24, and can stay illuminated based once the water pitcher 20 is sensed as being docked onto the shelf 24 adjacent the sensor 40.

Figure 4:
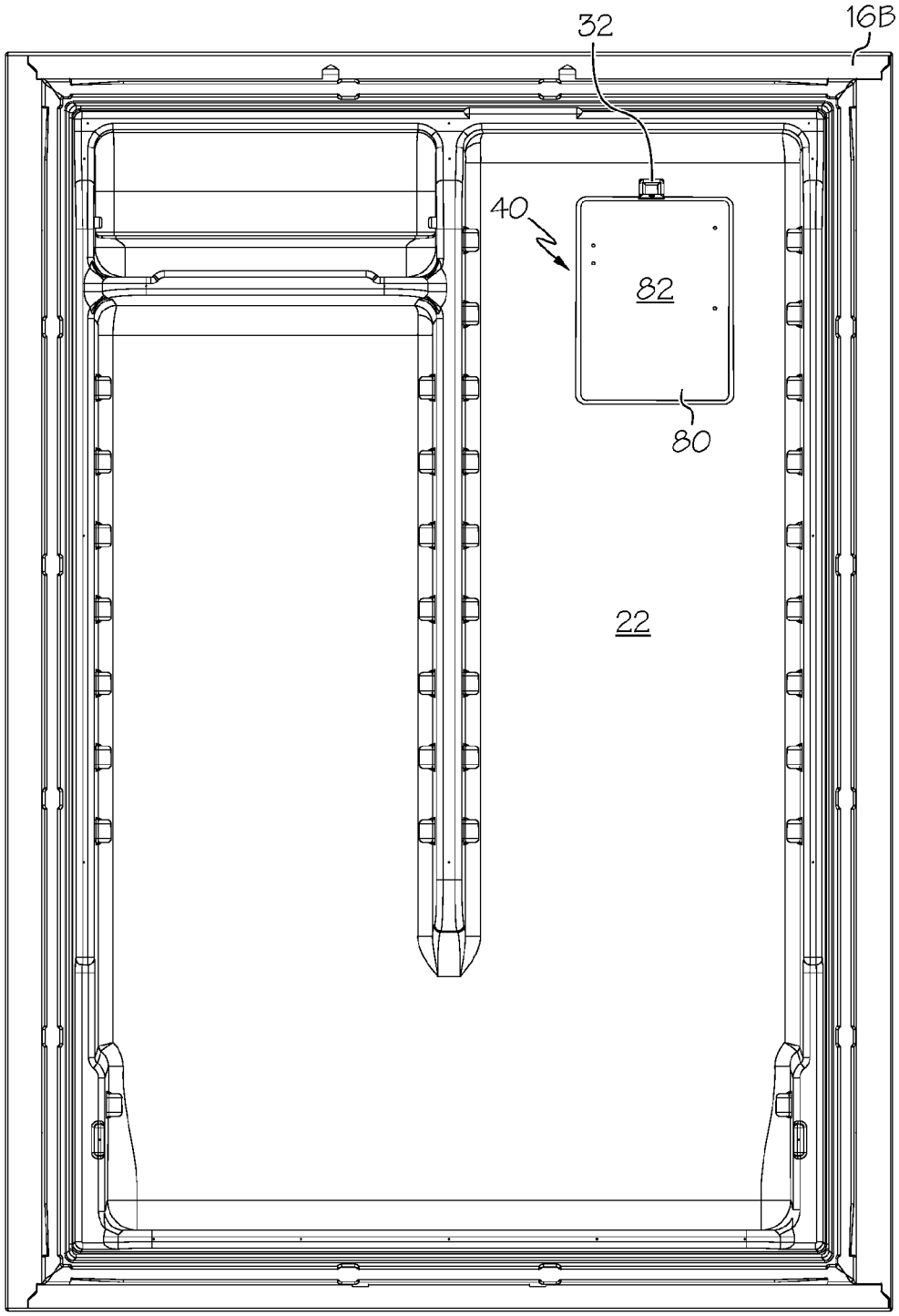
FIG. 4 is a front view of the refrigerator door of FIG. 3 without the water pitcher.

The capacitive sensors 61-69 can be coupled to a dielectric plate 80 located adjacent to the water pitcher 20. Some or all of the dielectric plate 80, capacitive sensors 61-69, control 50 and electrical connections, spout 32, actuator 34, and/or associated water lines can be foamed-into the refrigerator door during the manufacturing of the refrigerator. Alternatively, some of these elements may be attached to internal mounting structure after the refrigerator door liner and/or insulating foam has been installed. The dielectric plate 80 can be formed of various materials that generally will not interfere with the operation of the capacitive sensors 61-69 (or other types of sensors). The dielectric plate 80 can have a geometry corresponding to the geometry of the water pitcher 20. For example, the dielectric plate 80 can have a generally planar geometry with a face 82 (see FIG. 4) configured to engage an external side wall of the water pitcher 20. Still, the geometry of the dielectric plate 80 can closely correlate to the external geometry of the water pitcher 20 adjacent thereto so that the dielectric plate 80 mates closely with the water pitcher 20. It is contemplated that the geometry of the dielectric plate 80 could closely correlate but not touch the external geometry of the water pitcher 20 so as to provide a desired air gap therebetween. The face 82 of the dielectric plate 80 can be made of a material and/or have surface features that are compatible with the external side wall of the water pitcher 20, so as not to cause damage or scratching of the water pitcher 20 via contact. The face 82 may also have cutouts for the indicators 71-74 or be light transmissible so that the indicator lights can be viewed therethrough. It is appreciated that the sensor 40 shown in FIG. 5 is illustrated without the face 82 of the dielectric plate 80 for clarity of the underlying capacitive sensors 61-69.

Additionally, the dielectric plate 80 can be biased towards the water pitcher 20. Generally, capacitive sensor performance is increased when located relatively close to the item to be sensed. In one example, the dielectric plate 80 can be resiliently biased close to the water pitcher 20 to reduce an air gap therebetween. Preferably, the dielectric plate 80 is resiliently biased into engagement with the water pitcher 20 so that there is little or no air gap between the exterior surface of the water pitcher 20 and the face 82 of the dielectric plate 80. While some air gap(s) may exist, it is beneficial to have little or no air gap between the exterior surface of the water pitcher 20 and the areas of the dielectric plate 80 with the capacitive sensors 61-69. The dielectric plate 80 can be biased in various manners, such as via one or more springs 84 or the like. Multiple springs 84 can be utilized to permit the dielectric plate 80 to move relative to the door 16B at various angles, so as to facilitate insertion or removal of the water pitcher 20 and/or contact of the dielectric plate 80 with the water pitcher 20. Various configurations are contemplated. For example, two springs 84 can be provided at the top and bottom, or on either side, or even four springs 84 could be provided at the corners or one on each side.

Figure 6A:
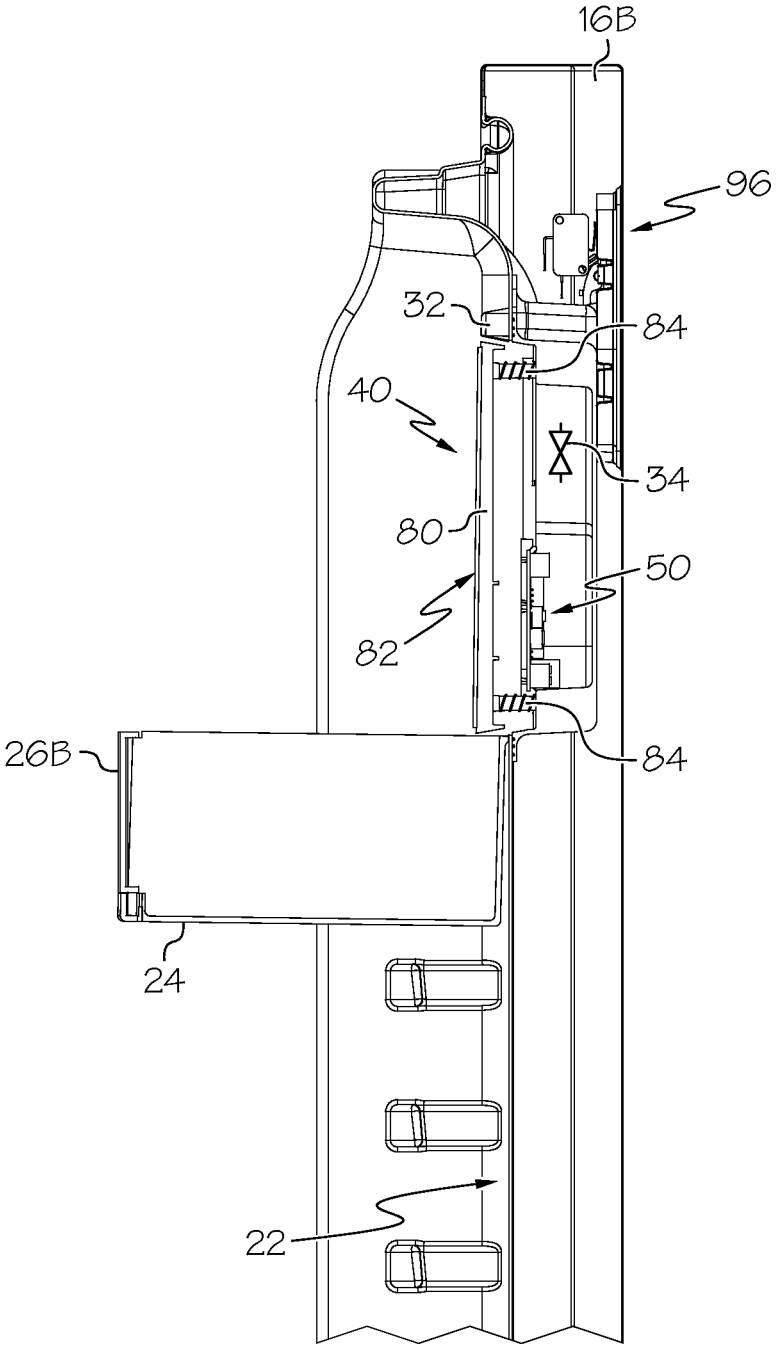
FIG. 6A is a side view of the refrigerator door and sensing circuit without the water pitcher.
Figure 6B:
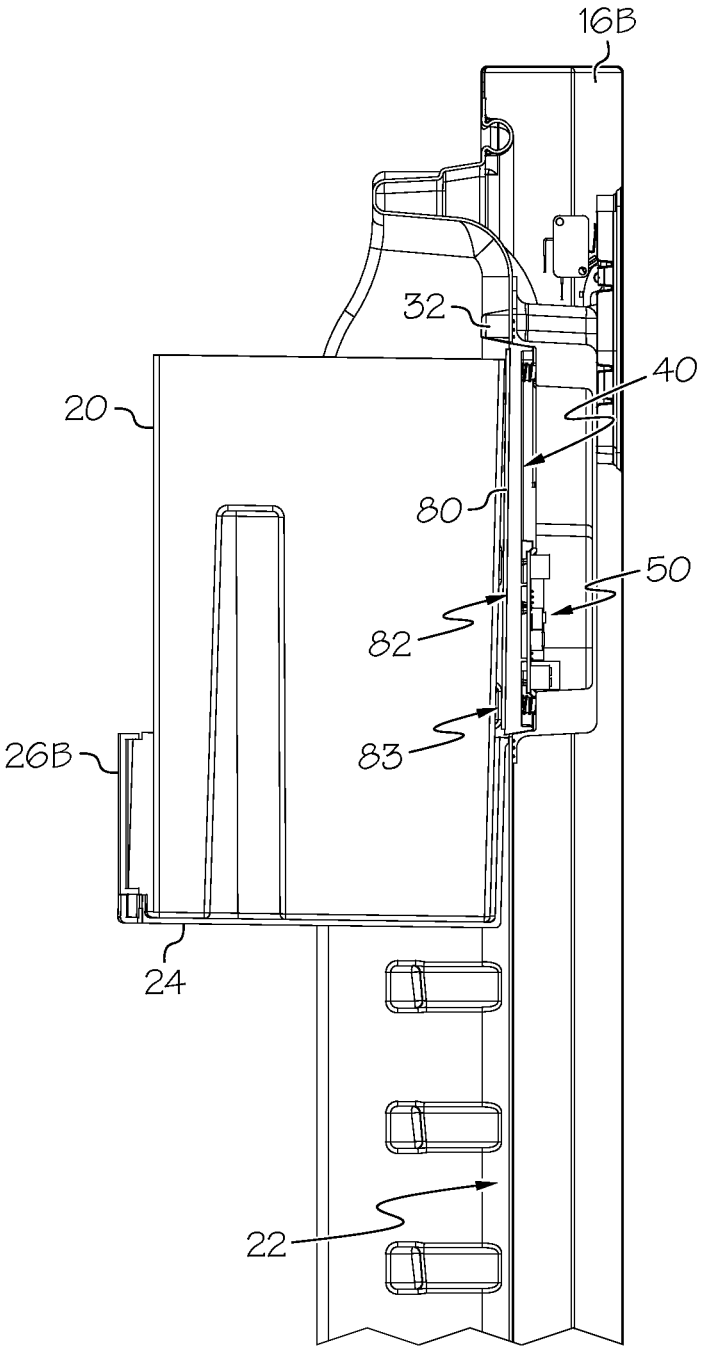
FIG. 6B is similar to FIG. 6A, but includes the water pitcher.
Figure 7:
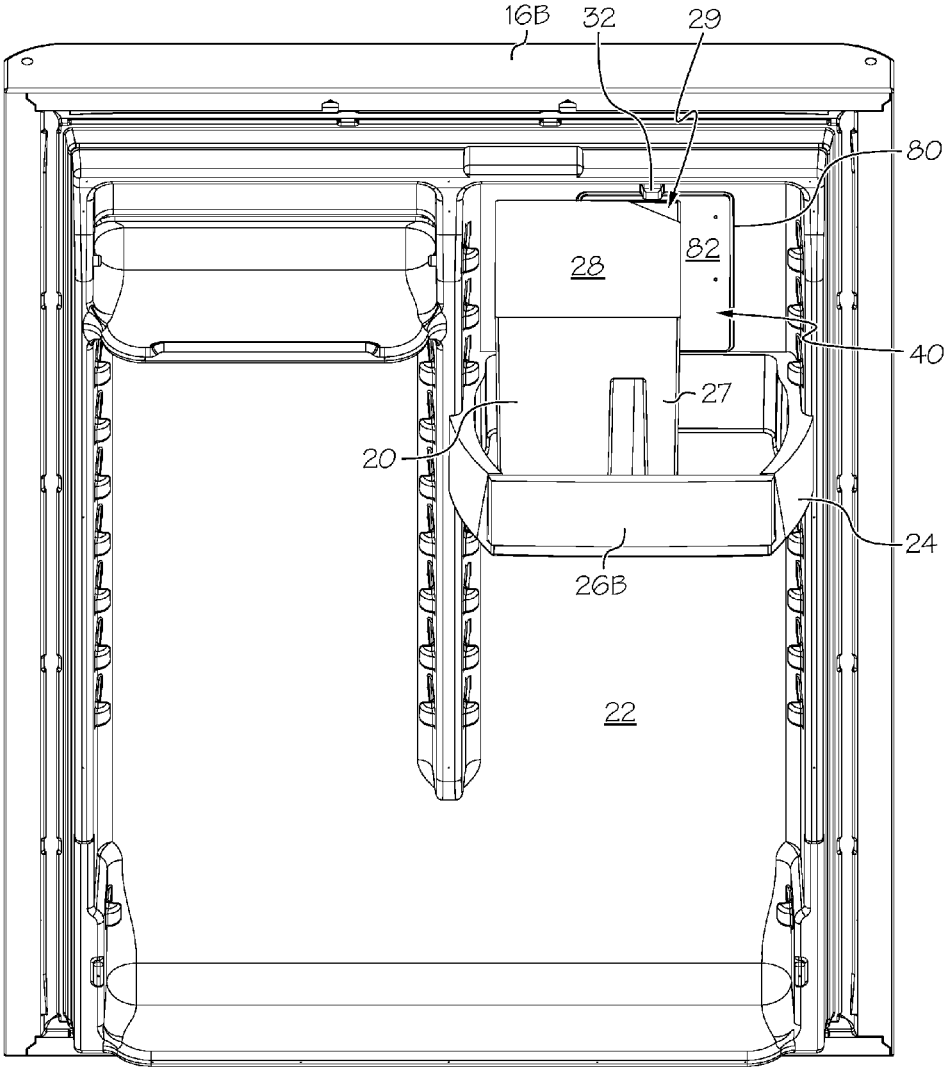
FIG. 7 is a top perspective view of the refrigerator door and water pitcher of FIG. 3.

Turning to FIG. 6A, the water pitcher 20 is shown removed from the shelf 24. The dielectric plate 80 is biased away and spaced a distance apart from the interior surface 22 of the door 16B by the springs 84. Next, turning to FIG. 6B, the water pitcher 20 is shown inserted into the recess or well 25 of the shelf 24. The water pitcher 20 is nestled snugly between front surface 26B of the shelf and the biased dielectric plate 80, which compresses the springs 84. The dielectric plate 80 is now moved and towards the interior surface 22 of the door 16B, and is in engagement with the external surface of the water pitcher 20. Thus, the action of inserting the water pitcher 20 onto the shelf 24 compresses the springs 84 to bias the face 82 of the dielectric plate 80 against the water pitcher 20. It is further contemplated that the filling mechanism could be disabled until the dielectric plate 80 is now moved and towards the interior surface 22, such as determined via any of the capacitive sensors 61-69, or a switch or the like (not shown). In addition or alternatively, the exterior surface of the water pitcher 20 can include one or more projections 83 configured to engage the face 82 of the dielectric plate 80 to facilitate movement thereof and/or provide orientation based upon sloping or other geometry of the water pitcher 20 that may or may not match that of the face 82. In addition or alternatively, the dielectric plate 80 can include on or more mechanical stops on the rear side thereof so as to limit and/or orient the dielectric plate 80 when it is compressed by the water pitcher 20.

An example method of operation can include some or all of the following steps. The steps can be implemented via the control 50 or main controller of the refrigerator 10. The sensor 40 can sense the presence of the water pitcher 20 on the shelf 24 of the interior surface 22 of the door 16A, 16B, such as via the capacitive sensors 66-67. The sensor 40 can also sense a presence of liquid within the water pitcher, such as via the capacitive sensors 61-65. Next, the control 50 can operate the actuator 34 to selectively permit dispensing of the liquid into the water pitcher 20 via the spout 32. The liquid dispensing can continue until the predetermined "full" water pitcher 20 is sensed by the sensor 40, and then closes the actuator 34 to stop the flow of liquid from the spout 32. Additionally, the control 50 could selectively adjust the actuator 34 to increase or decrease the liquid flow rate from the spout 32 based upon the amount of liquid contained in the water pitcher 20 and/or sensed rate of change of liquid amount in the water pitcher 20. For example, the control 50 could cause a relatively empty water pitcher 20 to fill faster, while slowing the filling rate when the water pitcher 20 is nearing a "full" condition.

After sensing the presence of the water pitcher 20 and the presence of liquid therein, the control 50 can initiate a timer. The timer can be set to countdown from the predetermined amount of time (e.g., a few days, a week, two weeks, or other value). The timer can be initiated at the start or the completion of the filling operation. Thereafter, the control 50 can indicate a stale liquid condition if the timer expires before the water pitcher 20 has been removed from the door 16A, 16B, such as removed from the shelf 24. The stale liquid condition can be indicated by the lights 73, 74, user interface 19, or other manner.

The method can include various additional steps. For example, the sensor 40 can sense an absence of the water pitcher 20 on the interior surface 22 of the door 16A, 16B. For example, the capacitive sensors 66-67 can sense that the water pitcher 20 has been removed from the shelf 24. Afterwards, the timer can be reset once the presence of the container is subsequently sensed on the interior surface of the door. For example, once the capacitive sensors 66-67 sense that the water pitcher 20 has been replaced onto the shelf 24, the timer can be reset back to its original value, and can restart the countdown. In addition or alternatively, it is also contemplated that the timer could be initiated after each time liquid is dispensed into the water pitcher 20. For example, the liquid can be dispensed into the container, and thereafter the timer can be reset once the liquid dispensing is complete.

It is contemplated that the fill mechanism could also be used as a manual water dispenser for filling a user's glass when the water pitcher 20 or carafe is not in use. For example, whether or not the refrigerator contains an external water dispenser, the internal fill mechanism could be used as a manual water fill dispenser. For example, a manual operation button (not shown) could be provided to operate the control 50 and/or actuator 34 to manually dispense water from the spout 32. Still, the fill mechanism could be locked until the sensor 40 determines a water pitcher 20 or other suitable container is located below the spout 32. It is further contemplated that the fill mechanism could be utilized with an external water dispenser 90 (see FIG. 2) located on an exterior or side edge 17 of the door 16A to dispense water through the door. A button 92, motion sensor, etc. or other suitable input device can be provided in communication with a control configured to operate an actuator to dispense water or another liquid via the dispenser 90 when the button 92 or other input device is manipulated. The liquid supply to the dispenser 90 can be the same or different as the spout 32 for the water pitcher 20, and may similarly be filtered and/or chilled. In addition or alternatively, a dispenser 96 (see FIG. 6A) could be provided on the exterior front side of the door 16B.

If the fill mechanism is located on the inside of the refrigerator door, one or more water lines can be provided to the refrigerator door to provide the water supply for the fill mechanism and/or a separate exterior water dispenser. A control system, operation controls, supply valves and the like for controlling the flow of water can be located in close proximity or even remotely from the fill mechanism. It is further contemplated that the water pitcher or carafe could further include a manual spout for filling a user's water glass from the water contained in the pitcher or carafe without requiring the user to remove the water pitcher or carafe from the door. It is further contemplated that an ice dispenser could be combined and/or utilized with the fill mechanism. The ice could be dispensed via the dispenser 90 or inside the refrigerator.

In addition or alternatively, it is contemplated that one or more sensors (not shown) could be provided to sense an overflow and/or spilled water condition in the recess 25 of the shelf 24. For example, upon sensing an overflow or spilled water condition, the control 50 can close the actuator 34 to stop dispensing liquid from the spout 32, and notify the user of a spilled water condition. The control 50 can maintain the actuator 34 in the closed position until the user rectifies the spilled water condition.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigerator, comprising:

a cabinet defining a fresh food compartment;

a door pivotally mounted to the cabinet and comprising an interior surface in communication with the fresh food compartment when the door is closed;

a liquid dispenser arranged on the interior surface of the door;

a container supported on the door and configured to receive liquid from the liquid dispenser;

a sensor configured to sense a property of the container or liquid received in the container; and a control in communication with the sensor and configured to regulate dispensing of liquid into the container based upon the sensed property, wherein the sensor utilizes a capacitive sensor coupled to a dielectric plate located adjacent to the container and the dielectric plate is resiliently biased into engagement with the container.

2. The refrigerator of claim 1, where in the liquid dispenser further comprises a spout for dispensing the liquid into the container.

3. The refrigerator of claim 2, further comprising an actuator operated by the control and configured to selectively permit dispensing of the liquid via the spout.

4. The refrigerator of claim 1, wherein the property sensed by the sensor is a presence of the container adjacent to the liquid dispenser.

5. The refrigerator of claim 1, wherein the property sensed by the sensor is an amount of liquid within the container.

6. The refrigerator of claim 1, wherein the sensor utilizes sound waves.

7. The refrigerator of claim 1, wherein the sensor utilizes an electrically conductive-path within the liquid in the container.

8. The refrigerator of claim 1, wherein the sensor comprises a plurality of capacitive sensors configured to sense a plurality of different amounts of liquid within the container.

9. The refrigerator of claim 8, wherein the plurality of capacitive sensors are arranged in an array positioned to extend along a length of the container.

10. The refrigerator of claim 1, further comprising a user input configured to select one of a plurality of fill different amounts of liquid within the container.

11. The refrigerator of claim 1, further comprising a feedback system configured to indicate at least one of a current amount of liquid in the container and a selected amount of liquid in the container.

12. The refrigerator of claim 1, further comprising an auxiliary liquid dispenser arranged on an exterior surface of the door.

13. The refrigerator of claim 4, further comprising a feedback system configured to indicate a stale liquid condition when the container has not been removed from the door after a predetermined amount of time has elapsed.

14. A refrigerator, comprising:

a cabinet defining a fresh food compartment;

a door pivotally mounted to the cabinet and comprising an interior surface in communication with the fresh food compartment when the door is closed;

a liquid dispenser arranged on the interior surface of the door comprising a spout and a support shelf arranged below the spout;

a container supported on the support shelf of the door and configured to receive liquid from the spout;

a sensor resiliently biased into contact with the container and configured to sense a property of the container or liquid received in the container; and a control in communication with the sensor and configured to regulate dispensing of liquid into the container via the spout based upon the sensed property, wherein the sensor is a capacitive sensor coupled to a dielectric plate resiliently biased into contact with the container.

15. The refrigerator of claim 14, wherein the property sensed by the sensor is at least one of a presence of the container adjacent to the liquid dispenser, and an amount of liquid within the container.

* * * * *